United States Patent [19]

Curran

[11] 4,150,656

[45] Apr. 24, 1979

[54] GAS FIRED GUN WITH GAS CARTRIDGE PUNCTURE DEVICE

[75] Inventor: Roger Curran, Stratford, Conn.

[73] Assignee: Bangor Punta Operations, Inc., Greenwich, Conn.

[21] Appl. No.: 765,555

[22] Filed: Feb. 4, 1977

[51] Int. Cl.[2] ..... F41B 11/06

[52] U.S. Cl. ..... 124/74; 141/19; 222/5

[58] Field of Search ..... 124/74; 222/3, 5, 81, 222/83.5, 85,86,88; 9/318; 141/19, 286, 329; 280/737; 137/68 R

[56] References Cited

U.S. PATENT DOCUMENTS

| | | | |
|---|---|---|---|
| 2,536,221 | 1/1951 | Rector et al. | 222/5 X |
| 3,048,991 | 8/1962 | Iketani | 222/3 |
| 3,064,740 | 11/1962 | Knapp | 222/5 X |
| 3,261,341 | 7/1966 | Merz | 124/74 |
| 3,999,534 | 12/1976 | Chapin et al. | 124/74 |

*Primary Examiner*—Richard T. Stouffer

*Attorney, Agent, or Firm*—Patrick J. Walsh

[57] ABSTRACT

Disclosed is a gas fired gun having a valve body for communicating gas under pressure from a gas cartridge to the gun barrel to fire a projectile. The gun has a frame carrying a chamber for receiving a gas cartridge and a lever for urging the cartridge in the chamber against a conical element carried in a stepped bore in the valve body. A retainer ring having triangular shaped projections disposed in a direction toward the tip of the conical element is provided about the element. A seal seats on a stepped shoulder in the bore and a retainer nut bears against the seal which, in turn, bears against the triangular projections on the ring to retain the conical element in the bore. Upon actuation of the lever, the end of the cartridge is fully inserted into the bore and pierced by the element. When the lever is in final position, the cartridge backs off the piercing element to enable gas flow through the seal between the projections of the retainer ring and the element into the valve body passage.

21 Claims, 16 Drawing Figures

10
12
14
16
18
20
24
27
28
40

18
20
22
24
26
28
30
32
33
40
42
44
45
46
47
48
49
50
52
54
56
58
60
62
64
66
68
100
106
110
116
118
120
124
C

Fig. 5.
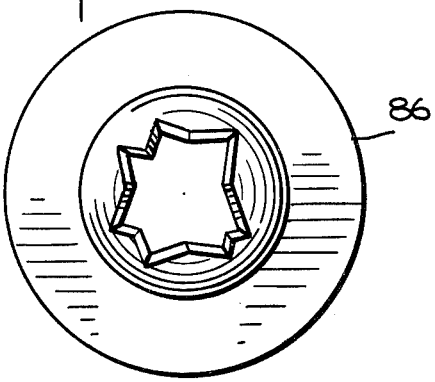
Fig. 6.
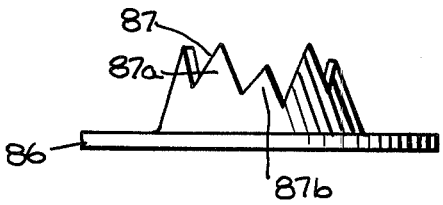
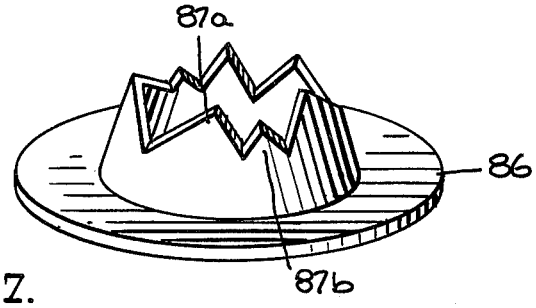
Fig. 7.
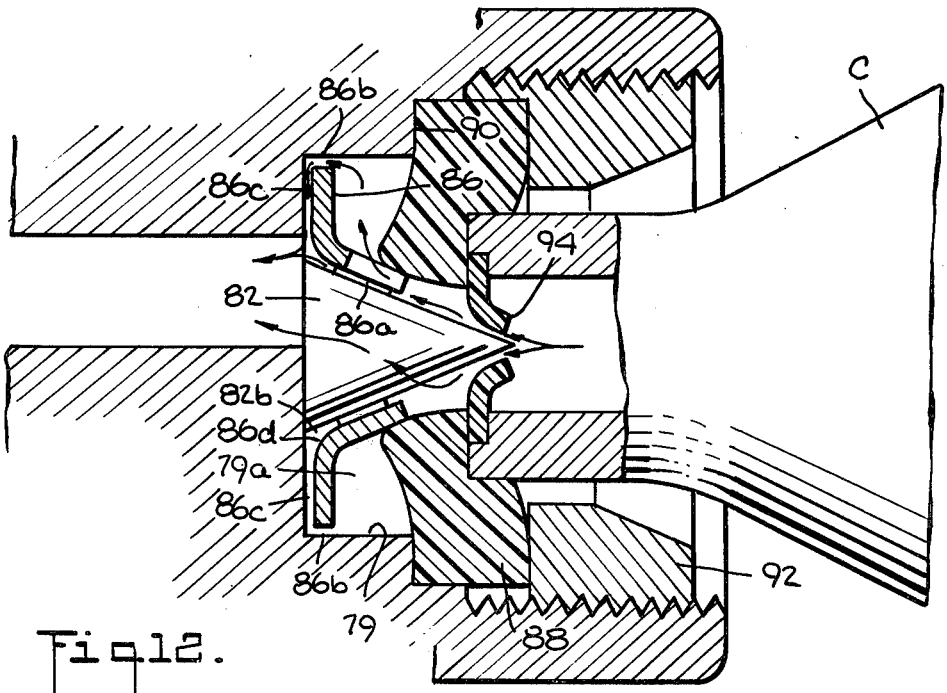
Fig. 12.

GAS FIRED GUN WITH GAS CARTRIDGE PUNCTURE DEVICE

The present invention relates to a gas fired gun and particularly relates to a novel and improved device for puncturing the end of a gas filled cartridge and facilitating improved flow of gas from the cartridge to the valve assembly associated with the gun.

Conventional gas fired guns utilize a cartridge containing gas under high pressure as the propellant charge for firing a BB shot from the gun. In certain guns, the cartridge is inserted into a chamber carried by the gun frame. A mechanism is provided for urging the end seal cap of the cartridge onto a puncture pin carried by part of the valve assembly. The pin punctures the cartridge seal cap whereby gas escapes from the cartridge into the passage of a valve assembly. Conventional puncture pins present a number of problems which interfere with satisfactory operation of gas fired guns. In one type of puncture pin there is an internal duct to provide a gas flow path from the cartridge to the firing valve. Frequently such pins are of small diameter to reduce the force required to pierce the seal cap in the gas cartridge. Because of these conditions piercing pins frequently break requiring a periodic replacement. Piercing pins sometimes stick in the gas cartridge opening such that when the gas cartridge is removed the tip of the pin is broken or bent. Other piercing pins are of solid construction and do not include an internal gas duct. These pins must be withdrawn slightly to permit gas flow from the cartridge into the firing valve mechanism. Such retraction must be done carefully to avoid breaking the gas seal and to avoid exhausting the gas cartridge to the atmosphere. Firing pin retraction is difficult to achieve within specified limits because conventional $CO_2$ cartridges vary in length by as much as 0.080 inches. It will be understood that this manufacturing variance will create unique problems for retractable puncture pins. For example, with longer bottles, a retractable pin may not provide sufficient clearance for adequate gas flow to the firing valve. On the other hand shorter bottles may leak gas to the atmosphere. Puncture pins sometimes blank the seal cap causing a fragment of blanked metal to damage filter screens or the interior of the valve.

There is a general problem of dirt or debris entering through filter screens either from the outside or from the interior of the gas cartridge causing operating difficulties with conventional puncturing systems. In the manufacture of commercial $CO_2$ cartridges metal chips, rust, oil and water are commonly sealed with the $CO_2$ charge in the cartridge. Idle guns without a $CO_2$ cartridge in place are susceptible to dirt entering the gas flow passages of the firing valve assembly. During piercing of the gas cartridge end seal, portions of the bottle such as paint, plating materials, dirt on the end seal surface, end seal fragments may and often do enter the valve assembly.

Conventional rubber-like sealing gaskets used for providing a gas seal around the punctured seal cap of the gas cartridge will take a "set" when the gas bottle is pressed into the face of the seal. In order to prevent leakage past the sealing surface a significant force against the seal is required. The sealing force is usually achieved by a small compression of a rigid rubber or a very large compression of a soft rubber. The rubber or rubber-like material is usually backed by a solid member generally a portion of the valve body. Problems occur when gas bottles of different sizes within the usual manufacturing variations must be compressed into a given sealing gasket. A gasket having a "set" for a longer bottle will frequently fail to seal shorter bottles.

The present invention provides a gas fired gun having a novel and improved device for puncturing the seal cap of a gas cartridge for use therewith which minimizes or eliminates the foregoing and other problems associated with puncture devices used in prior gas fired guns and provides a novel and improved device for puncturing the seal cap of a cartridge in a gas fired gun having various advantages in construction, operation and use in comparison with such prior puncture devices. Particularly, the present gas fired gun is provided with a novel and improved device for puncturing the seal cap of the gas cartridge which facilitates and improves the flow of gas from the cartridge about the device into the valve assembly and which is also characterized by novel and improved means for retaining the puncture pin in the valve assembly thereby facilitating manufacture and assembly of the various parts of the puncture device.

In addition the invention provides a sealing arrangement in which a hard rubber or rubber-like sealing gasket is clamped in place in sealing relation to the punctured gas cartridge. The sealing gasket is unsupported by any backing member. Instead gas from the cartridge enters behind the sealing gasket for the purpose of returning the rubber back to its normal position after each bottle is pierced. This arrangement also requires less force applied to the gasket surface in order to achieve the seal. The sealing gasket bends slightly as a seal is established. This bending force is small in comparison to the compression force normally applied to a sealing gasket. The small bending force applied to the unsupported gasket by the mouth of the gas cartridge is augmented by gas pressure on the opposite face of the gasket to achieve the desired seal.

More particularly, the gas fired gun in which the novel and improved device for puncturing the gas cartridge of the present invention is provided comprises a frame carrying a barrel, a chamber for receiving a gas filled cartridge, a trigger mechanism, a valve assembly, and the novel and improved puncture device of the present invention disposed on the valve assembly at one end of the cartridge chamber for supplying gas from the cartridge through the puncture device to the valve assembly. Upon actuation of the trigger, the valve is momentarily opened to release a charge of gas which serves to propel or fire a BB shot through the gun barrel. The novel and improved puncture device includes a conical element or puncture cone which seats against the base of a stepped bore in the valve assembly, the bore having a passage offset from the axis thereof to provide an opening between the puncture cone and the valve passages. A retainer ring is also seated against the base of the bore about the puncture cone and includes an annular base and a plurality of generally triangular shaped projections from the base about the puncture cone and projecting toward its tip. The tips of the triangular projections on the retainer ring alternately extend different axial lengths from the base of the ring. An annular seal is disposed in the bore and a retainer nut is threaded into the bore to retain the seal against a shoulder spaced from the base of the bore. The seal engages the tips of the longest axially projecting portions of the triangular projections to clamp the retainer ring against the bore base. This, in turn, clamps the puncture cone against the base of the bore. In addition the puncturing device provides an unsupported seal to permit and to take advantage of the combination of countervailing forces: a bending force exerted by the gas cartridge against the front surface of a sealing gasket and an opposing gas pressure force on the reverse face of the sealing gasket. These opposing forces cooperate and provide a gas seal. This unique arrangement is effective to seal gas cartridges which vary slightly in length approximately 0.08 inches in normal commercial production. This arrangement avoids the sealing gasket taking an excessive set under compressive forces of larger gas cartridges and thereafter being incapable of effectively sealing when shorter gas cartridges are employed.

Improved flow of gas from the cartridge into the valve assembly is provided by the foregoing construction and also in conjunction with an extractor and loader assembly which permits the cartridge to back off the puncture cone once the seal has been punctured. That is, when the cartridge is disposed in the chamber, a lever cams the cartridge forwardly such that the tip of the cone punctures the seal cap on the cartridge. The margins about the cartridge resiliently seal against the annular seal during puncture. The lever and cam surfaces are such that the cartridge is backed off the puncture cone to a controlled extent when the cartridge is fully loaded into the gun. This backing off of the cartridge seal cap from the puncture cone spaces the punctured margins of the seal cap from the tip providing a filtered flow of gas from the cartridge into the valve assembly through the controlled passages formed between the puncture cone and the punctured margins of the seal. The gas flow spaces are approximately 0.003 inches wide thereby to serve as an effective filter against particles smaller than those filtered by conventional gas gun filter systems. The gas further flows about the puncture cone inwardly of the seal between the smaller triangular projections and the cone into the valve passage. The slight movement of the cartridge away from the puncture device, however, is insufficient to break the seal.

According to the present invention the major portion of dirt or debris in the gas cartridge will be retained within the cartridge by controlling the gap between the puncture cone and the pierced end seal surfaces. This gap is controlled by a controlled "back-off" of the cartridge from the piercing pin during the cartridge piercing operation in virtue the contour of the camming surfaces forming part of the piercing mechanism.

According to the present invention gas flows from the cartridge through an annular zone defined by the confronting surfaces of the pierced end seal and the puncture cone. The annular zone averages 0.002 to 0.003 inches in width and effectively prevents most debris from leaving the cartridge. A second annular zone defined by the confronting surfaces of the puncture cone and its retaining washer and/or the retaining washer and the bottom of the stepped recess in the valve body serve as a back-up filter system for dirt coming from within the gas cartridge and as a primary filter system for all other sources of dirt.

According to the present invention dirt which is filtered out of the gas stream does not accumulate in the gun but is removed either with the spent gas cartridge or by the periodic cleaning which occurs during gas cylinder removal when residual gas in the valve flows backward through the filter to the atmosphere.

Accordingly, it is a primary object of the present invention to provide a gas fired gun having a novel and improved puncture device for the gas cartridge used with the gun.

It is another object of the present invention to provide a gas fired gun having a novel and improved puncture device for the gun's gas cartridge which filters the flow of gas from the cartridge into the gun's valve assembly.

It is still another object of the present invention to provide a gas fired gun having a novel and improved puncture device for a gas cartridge having improved means for retaining the puncture device in the valve body.

It is a further object of the present invention to provide a gas fired gun having a novel and improved puncture device for a gas cartridge wherein the gas cartridge is permitted to back off the puncture device thereby to establish a controlled gap for a filtered flowing of gas while retaining its seal in the valve assembly.

These and further objects and advantages of the present invention will become more apparent upon reference to the following specification, appended claims and drawings wherein:

FIG. 5 is an end elevational view of a punctured element retaining ring forming part of the puncture device illustrated in FIG. 3;

FIG. 6 is a side elevational view thereof;

FIG. 7 is a perspective view thereof;

FIG. 12 is an enlarged fragmentary vertical cross-sectional view of the puncture mechanism showing in particular the gas flow path from the cartridge to the valve interior;

Figure 1:
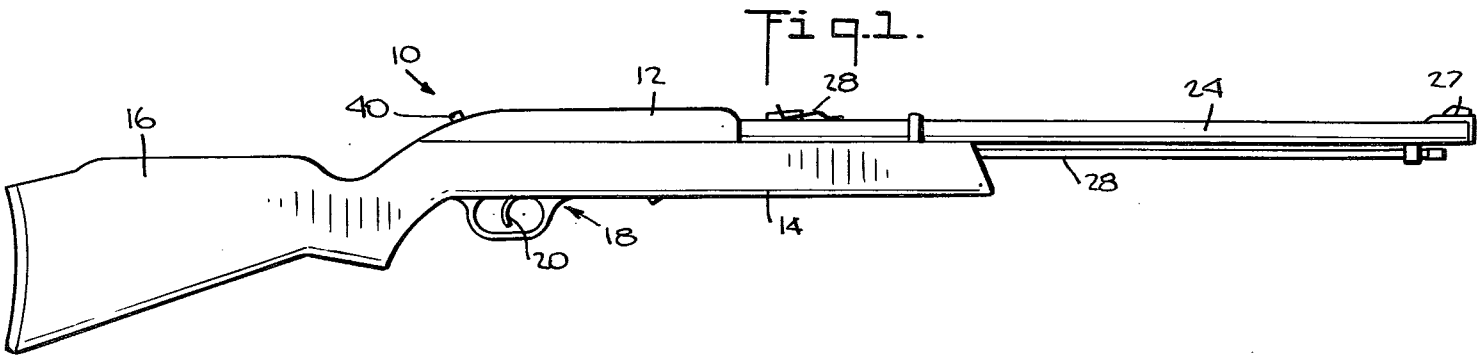
FIG. 1 is a side elevational view of a gas fired gun having a novel and improved puncture device for a gas cartridge constructed in accordance with the present invention.
Figure 2:
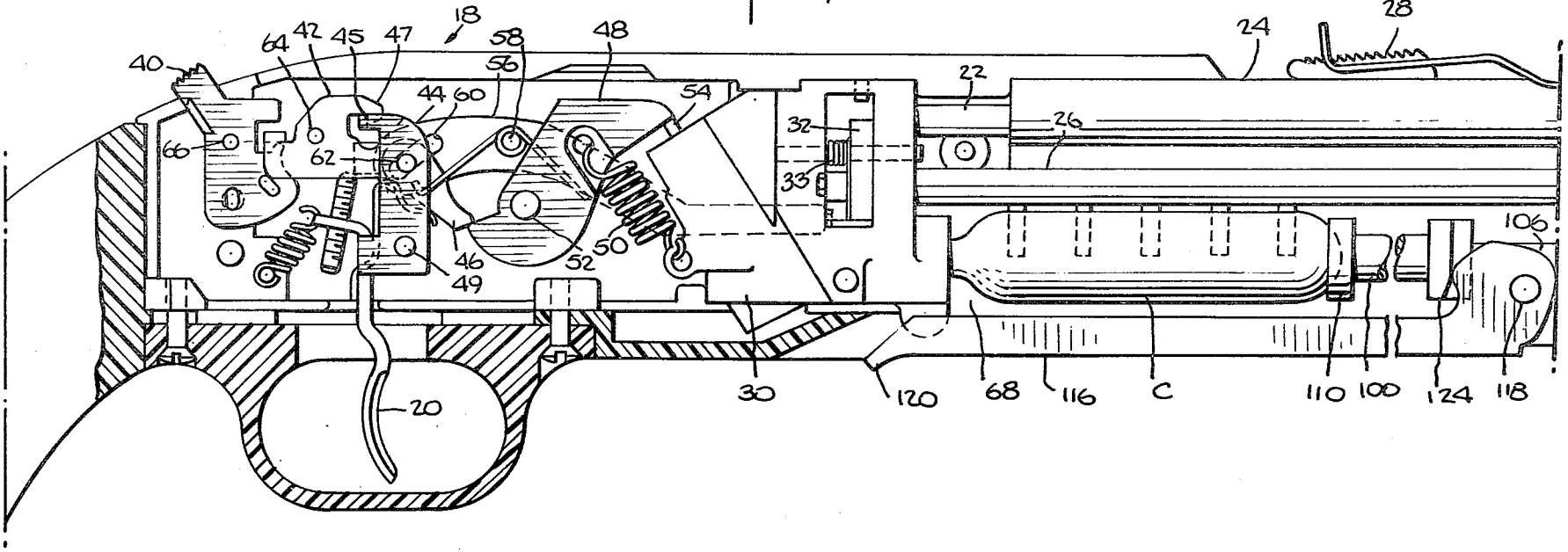
FIG. 2 is an enlarged fragmentary vertical and longitudinal cross-sectional view through the gun of FIG. 1.
Figure 3:
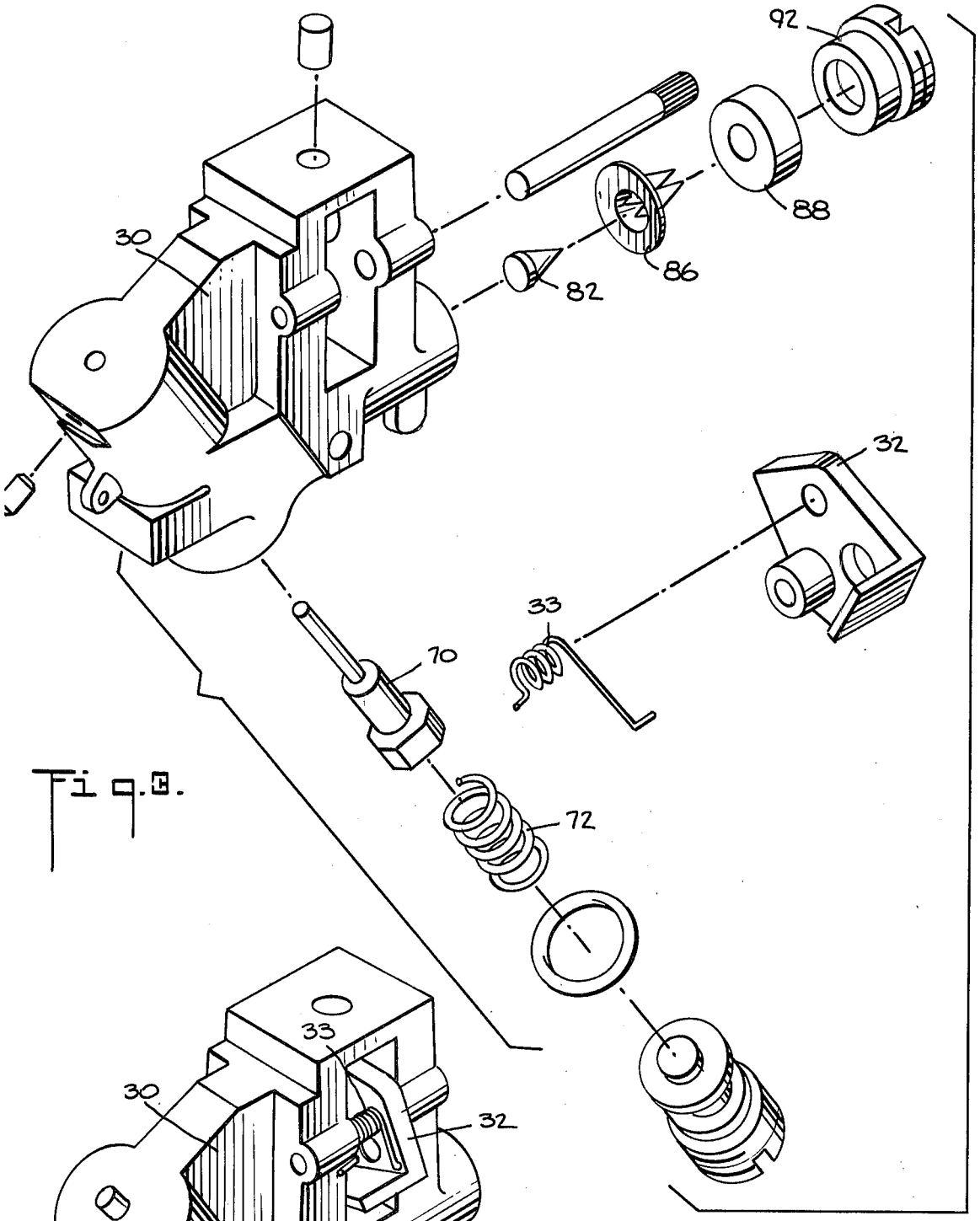
FIG. 3 is an exploded perspective view of the valve assembly of the gas fired gun hereof and illustrating the parts of a puncture device according to the present invention.
Figure 4:
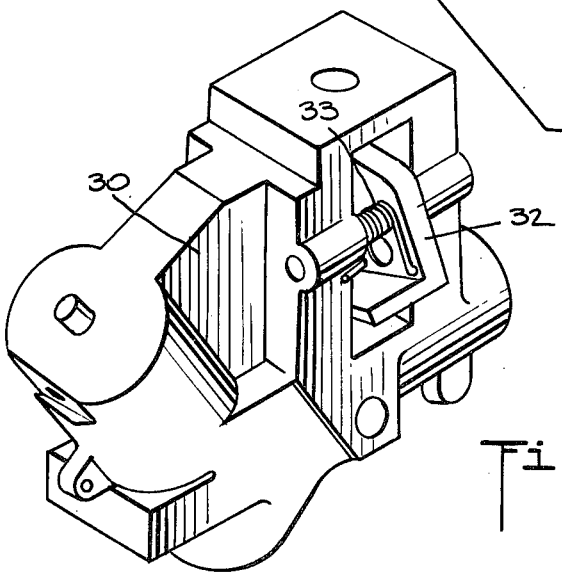
FIG. 4 is a perspective view of the valve assembly illustrated in FIG. 3 with the parts thereof in assembled juxtaposition.

Referring now to the drawings, particularly to FIGS. 1–2, there is illustrated a gas fired gun generally designated 10 comprised of a frame 12 having a forearm stock 14, a shoulder stock 16, a trigger mechanism generally designated 18 including a trigger 20, a barrel 22 within a shroud 24, a magazine tube 26 below barrel shroud 24, and front and rear sights 27 and 28 respectively on barrel shroud 24. Gun 10 is provided with a gas cartridge C (FIG. 2) which supplies gas under pressure to a valve assembly 30 for firing individual BB shot transferred from magazine tube 26 by a loader or transfer mechanism 32 to a position in line with barrel 22. A brief description of the trigger mechanism, valve assembly and shot transfer mechanism and their operation will now be provided to facilitate understanding of the overall operation of the gun and the novel and improved puncture device hereof. Trigger assembly 18 includes a safety lever 40, a safety latch 42, a generally U-shaped trigger element 44 forming an upper extension of trigger 20 and pivotally carrying a sear 46, and a hammer 48 biased by spring 50 for pivotal movement about shaft 52 into engagement with a valve firing pin 54. Trigger element 44 is carried for pivotal movement about a pin 49. A loader lever 56 is pivotally carried at 58 and has a kidney shaped opening 60 receiving the sear pivot pin 62. The safety latch 42 is pivoted about pin 64 and safety lever 40 is pivoted about post 66.

Figure 9:
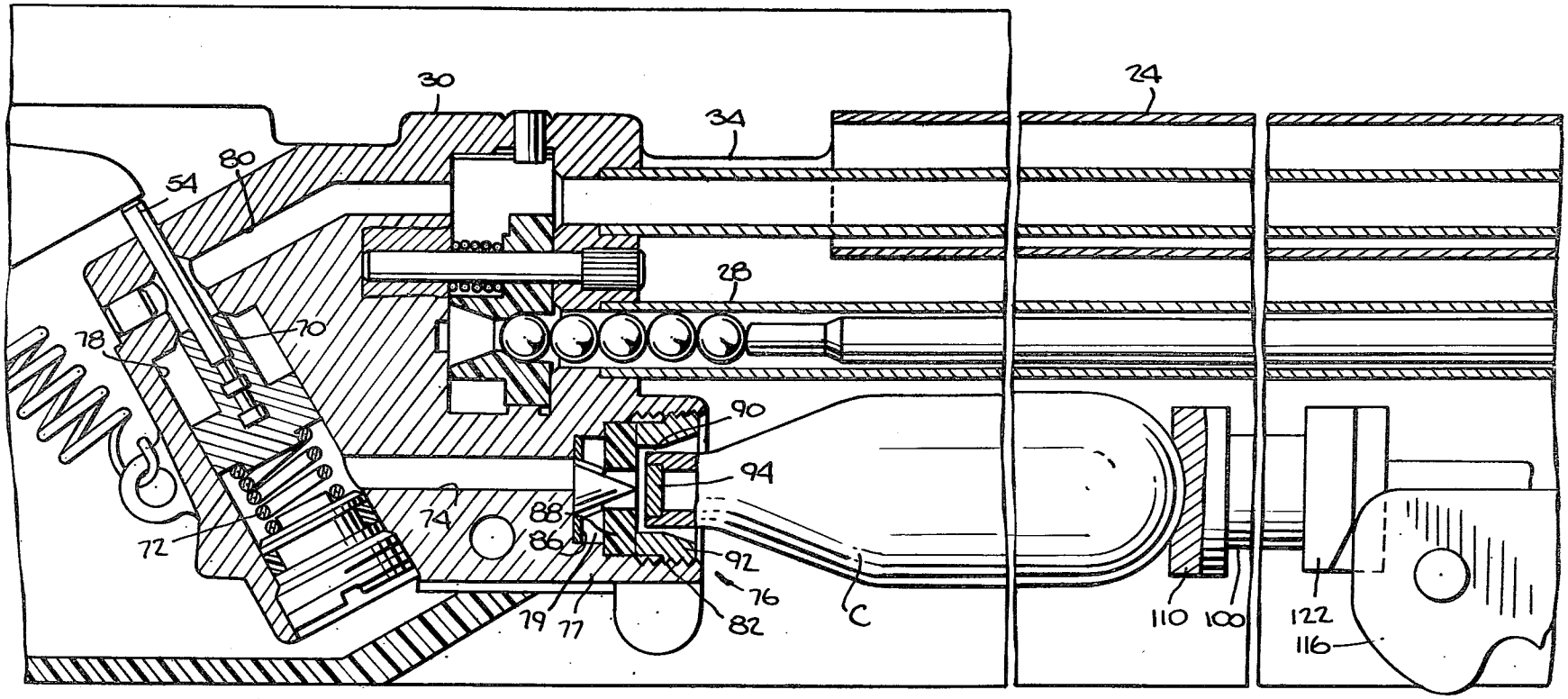
FIG. 9 is an enlarged vertical cross-sectional view with parts broken out for clarity and illustrating the gas cartridge in position for puncture by the puncture device hereof.

Valve assembly 30 and transfer mechanism 32 are best illustrated in FIG. 9. Valve assembly includes a stem 70 carrying a firing pin 54. The upper end of stem 70 seats against the valve housing. Stem 70 is polygonal in cross section and is biased into sealing engagement against the valve housing by a spring 72. A passage 74 lies in communication with the gas cartridge C at one passage end through a piercing device generally designated 76 and a valve chamber 78 at its opposite end. Passage 80 lies in communication with valve chamber 78 on the other side of the valve seal and lies in communication with barrel 34.

When gas cartridge C is in chamber 68 formed along the underside of frame 12 and in operative position with gas flowing therefrom past the piercing device 76 into valve assembly 30 in a manner explained in detail hereinafter the gun is ready for firing. To fire the gun, the safety lever 40 is advanced about post 66 to the fire position releasing the trigger mechanism 18 for firing the gun. This rotates safety latch 42 in counterclockwise direction as seen in FIG. 2 releasing trigger bar 45 from engagement with a catch 47 on safety latch 42. Squeezing trigger 20 causes sear 46 to engage hammer 48 and pivot it about pivot 52 to a cocked position against the bias of spring 50 and spaced from firing pin 54. Squeezing trigger 20 also pivots lever 56 about pin 58 and a hook, not shown, on the forward end of lever 90 pivots transfer arm 32 against the bias of spring 33 to locate a BB shot from magazine tube 26 into alignment with both barrel 22 and gas passage 80. Upon further pivotal movement of trigger 20, sear 46 drops off hammer 48 and spring 50 retracts hammer 48 against pin 54 momentarily depressing the latter. By depressing pin 54, a charge of gas from cartridge C communicates through passages 74, 78 and 80 in valve assembly 30 to a location behind the BB shot in transfer arm 32 whereupon the BB is fired or propelled through barrel 22.

Figure 14:
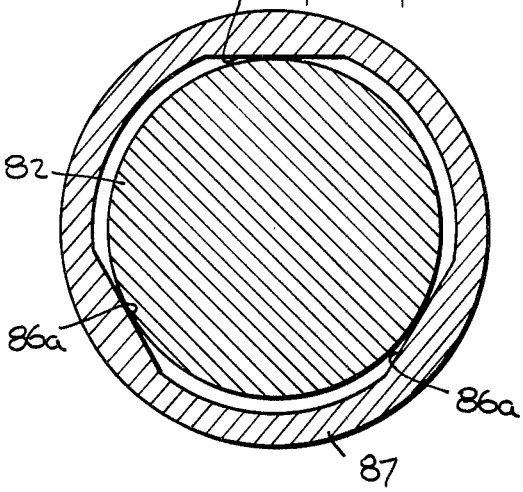
FIG. 14 is a section view taken along line 13—13 of FIG. 13 to illustrate means for spacing the piercing cone from its retainer washer.

Referring now particularly to FIG. 9, valve assembly 30 includes a boss 77 which projects forwardly into chamber 68. Boss 77 has a stepped bore 79 for receiving piercing device 76 hereof. Piercing device 76 includes a puncture cone 82 having its base seated against the base of bore 79. Cone 82 is retained within bore 79 by a retainer washer 86 having an annular base and a plurality of generally triangularly shaped projections 87*a* and 87*b* extending in an axial direction from its inner margin. Projections 87*a* and 87*b* alternately extend different axial lengths respectively. Particularly, triangular projections 87*a* extend axially a further distance than triangular projections 87*b*. Washer 86 is received about puncture cone 82 and seats against the base of bore 79. The interior surfaces of triangular projections 87 are spaced away from the surface of cone 82 by means of inwardly raised surfaces 86*a* (FIG. 14). The washer 86 centers and positions the puncture pin at the base of the bore 79. Note that passage 74 is radially offset from the axis of bore 79 such that the cone 82 does not fully cover passage 74.

A seal 88 is provided and comprises an annular washer which seats against a shoulder 90 spaced from the base of bore 79 thereby defining a void 79*a* behind a substantial portion of the seal. An externally threaded retainer nut 92 is threadedly received within bore 79 and bears against seal 88 to maintain it against shoulder 90.

When the seal, cone and washer are in proper position as illustrated in FIG. 9, the interior axially rearward margins about the opening in seal 88 bear against the outer tips of projections 87*a* of washer 86 and maintain washer 86 bearing against the puncture cone 82. This, in turn, centers puncture cone 82 within the bore. The tips of projections 87*b* are spaced inwardly from the rearmost face of washer 88 and conical tip of cone 82 extends slightly beyond the forward face of seal 88. Ridges 87*a* and 87*b* prevent the sealing gasket 88 from forming a seal against cone 87.

Before describing the manner in which seal cap 94 on gas cartridge C is punctured by the puncture cone 82, a brief description of the loader and extractor assembly which cooperates with the piercing device 76 to facilitate improved gas flow into the valve assembly will now be provided.

Figure 8:
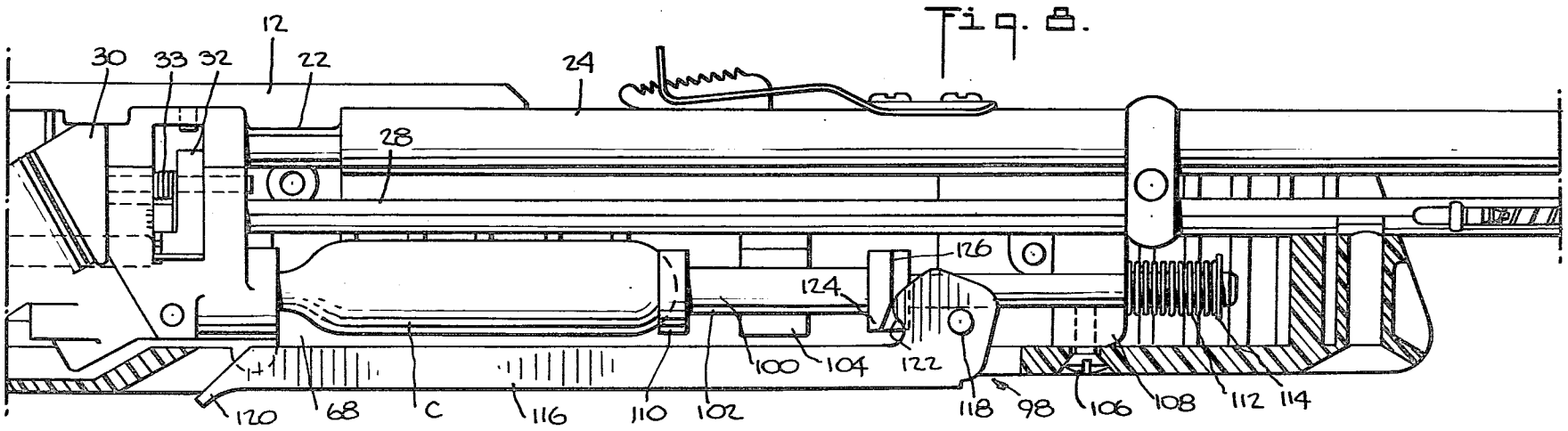
FIG. 8 is an enlarged fragmentary vertical cross-sectional view of the cartridge chamber and the loader and extractor assembly therefor.

Referring now to FIG. 8 there is illustrated a loader and extractor assembly, generally designated 98, for loading the gas cartridge C into chamber 68 and extracting it therefrom. Particularly, assembly 98 includes a cam rod 100 having a diametrically enlarged shaft portion 102 slidable in a guide 104. A reduced diameter shaft portion 106 of cam rod 100 is slidable in a guide 108. Each of guides 104 and 108 is carried by frame 12. The rearmost end of cam rod 100 carries a head 110, the rearmost face of which is concave or dished to conform in shape to the bulbous forward end or nose of gas cartridge C. The opposite end of cam rod 100 is encompassed by a spring 112. Spring 112 bears at one end against guide 108 and at its opposite end against a retainer washer 114 carried by cam rod 100. Spring 112 biases cam rod 100 for sliding movement in an axial direction away from piercing assembly 76.

To provide for insertion, retention and removal of gas cartridge C relative to chamber 68, an elongated lever 116 is pivotally carried on a pin 118 secured to frame 12. The rearmost end of lever 116 carries a tip 120 which projects slightly downwardly below the underside of frame 12 when the lever 116 lies flush along the frame closing chamber 68 whereby the lever can be grasped and pivoted downwardly. The forward end of lever 116 is provided with a pair of cam surfaces 122 which straddle the reduced diameter portion 106 of cam rod 100. Cam surfaces 122 bear against a cam block 124 carried by rod 100 intermediate the diametrically enlarged and reduced shaft portions 102 and 106 respectively. Cam block 124 is stepped along the side margins of its forward face to provide shoulders 126. The lower edges of shoulders 126 are tapered rearwardly to form entry cam surfaces 128. Cam surfaces 122 on lever 116 have high portions or tips 130. Lever 116 also has a pair of flats 131 contiguous to cam surfaces 122.

Figure 10:
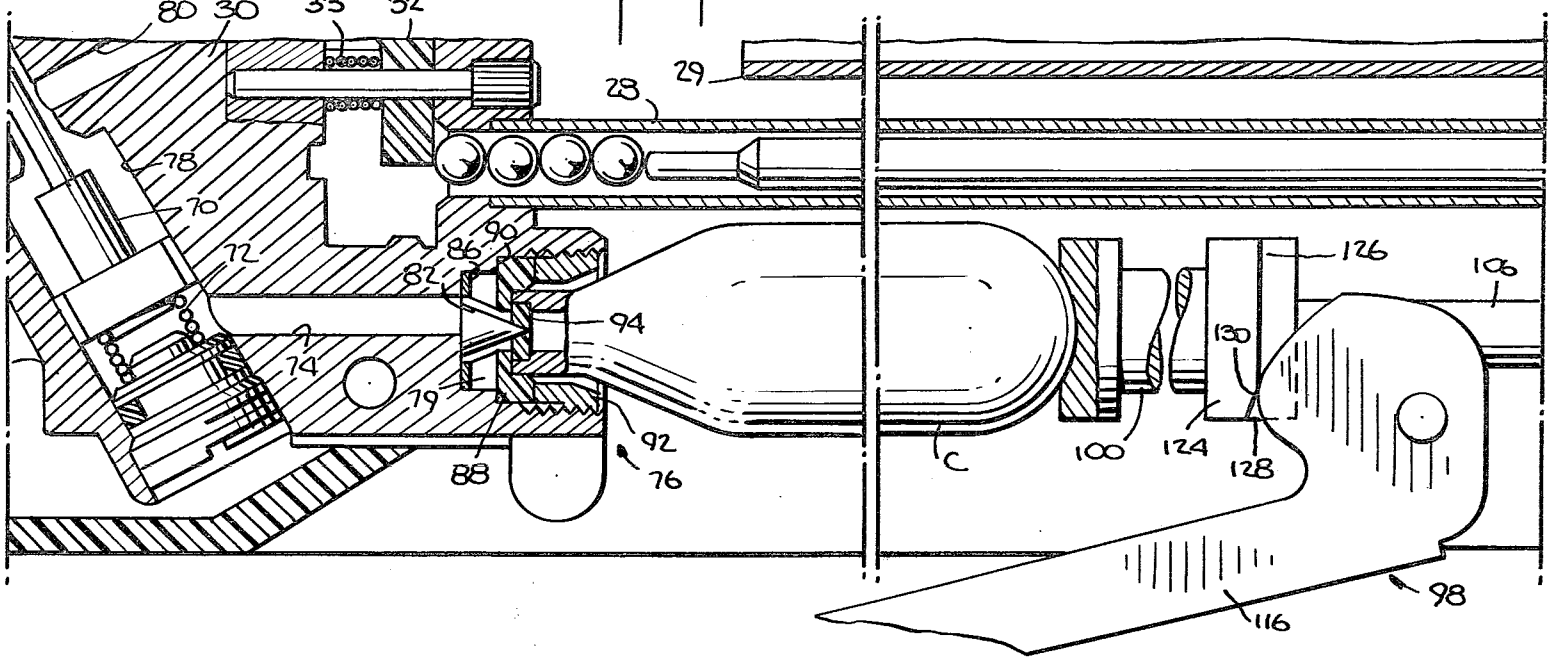
FIG. 10 is a view similar to FIG. 9 illustrating the gas cartridge being punctured and in its extreme rearmost position in the gun chamber.

By pivoting lever 116 outwardly away from frame 12, cam surfaces 122 are displaced forwardly away from shoulders 125 on cam block 124 enabling spring 112 to bias cam rod 100 axially forwardly. This enlarges chamber 68 in an axial direction enabling insertion of cartridge C into chamber 68. When the cartridge is disposed in chamber 68, its reduced end is disposed within the bore of piercing device 76. Lever 116 is then rotated or pivoted back from this first described position projecting from the underside of the gun to an intermediate or second position illustrated in FIG. 10. During this movement, cam surfaces 122 cam against shoulders 126 of the cam block and displace cam rod 100 and cartridge C axially rearwardly toward piercing device 76. Movement of cartridge C rearwardly forces the cartridge cap or seal against piercing cone 82 and the cartridge cap 94 is thus pierced. When the lever 116 lies in its intermediate position, cartridge C is advanced toward the piercing device such that the margins of the cartridge about its cap resiliently bear against seal 88 as illustrated in FIG. 10. Also, the high points 130 of lever 116 have moved along entry cam surfaces 128 on cam block 124.

Movement of lever 116 from its intermediate position illustrated in FIG. 10 to its third position wherein it lies flush against the underside of frame 12 causes the high points 130 to bear against shoulders 126 on cam block 124. Further movement of lever 116 toward its flush position moves high points 130 along an arc away from cam block 124. Thus, cam block 124 moves axially forward under the bias of spring 112 in following engagement with high points 130 whereby the rearward force on the cartridge is relieved enabling the cartridge to back off the piercing cone 82 as illustrated in FIG. 12.

Figure 11:
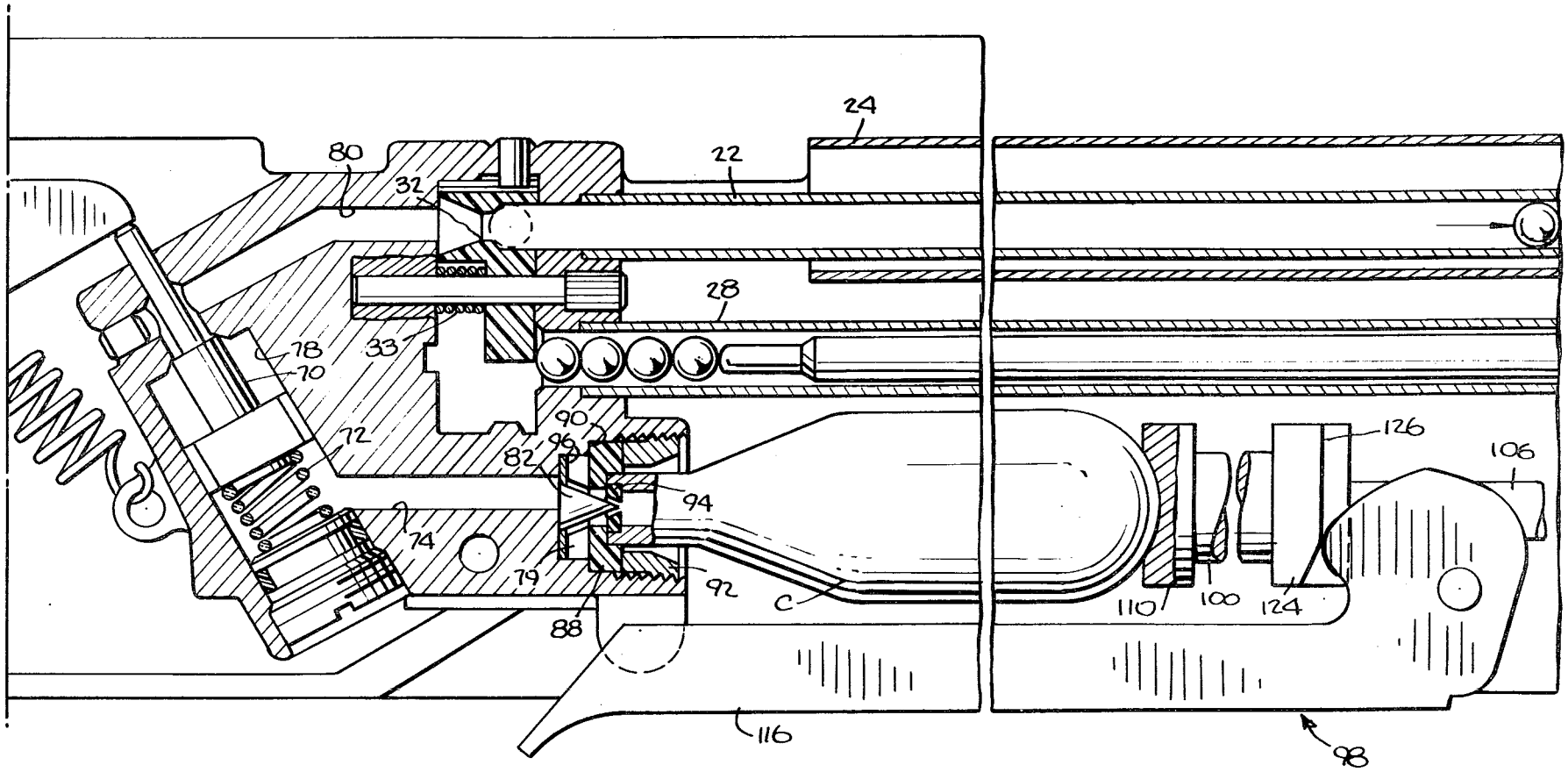
FIG. 11 is a view similar to FIG. 9 illustrating the gas cartridge and the various parts of the puncture device hereof when the gun is in firing position with the gas cartridge fully inserted and the gun operable.
Figure 13:
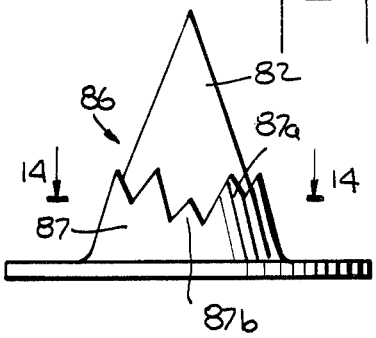
FIG. 13 is an enlarged side elevation view of a piercing cone or pin and its retainer washer which comprises a subassembly of the piercing mechanism.

Thus, as illustrated in FIGS. 11 and 12, improved flow of gas from cartridge C past the piercing device 76 into the valve assembly is provided as indicated by arrows in FIG. 12. That is, the margins of the puncture cone 82 are spaced approximately 0.002 to 0.003 inches from the margins defining the punctured opening in cap 94 of cartridge C whereby an annular flow passage through the end of the cartridge is provided. The gas flows over the face of the puncture cone 82 and into the flow passage 74. The flow of gas over the face of the puncture cone is facilitated by spacing the puncture cone from retainer washer 86 and the passage 74 by spacing surfaces **86*a* shown in FIGS. 13 and 14. An alternate gas flow path exists behind and under the retainer collar 86 by virtue of spacing surfaces 86*a* which position the collar up to 0.003 inches away from the base of bore 79. Surfaces 86*b* and 86*c* define an alternate flow path for the gas between the bore and the retaining washer 86. Either one or both of these passageways must be limited to 0.002 or 0.003 inches maximum width to prevent unfiltered gas from entering passageway 74**.

An inner curved surface **86*d* at the base of retainer washer 86 lies in confronting spaced relationship with the base 82*a* of puncture cone to define an annular channel 82*b***.

The annular channel provides for a conduit for gas flow from the gas cartridge past the face of piercing cone into the passageway 74. In addition, gas flowing along the underside of washer 86 past surface **86*c* enters passageway 74 by means of annular channel 82*b***.

The foregoing construction not only facilitates flow of gas, but also provides for a simple manufacture and assembly of these parts and mechanical retention of the puncture cone in the bore.

In addition gas flows to the void **79*a* behind the seal 88 and is effective to support seal member 88** in sealing relationship with the open end of the gas cartridge. This arrangement provides effective sealing of commercially produced gas cartridges which vary slightly in length.

Figure 15:
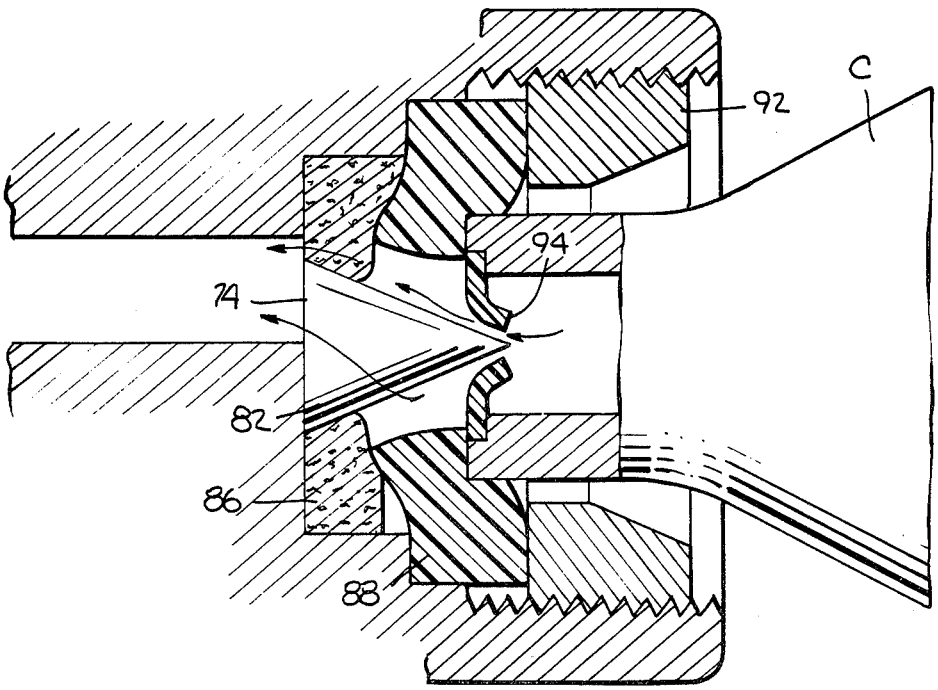
FIG. 15 is an enlarged fragmentary sectional view of a modified puncture mechanism showing in particular the gas flow path from the cartridge to the valve interior.

A modified puncture mechanism as illustrated in FIG. 15 may be used. In this embodiment, the retainer washer 86 for piercing cone 82 is a flexible porous material capable of filtering dirt particles of at least 0.002 inches in size. A porous felt or a porous urethane foam are suitable flexible materials for the retainer washer. As shown in FIG. 15, the gas cartridge C is pierced and retracted (as described above) to establish a gas path (as shown by arrow) through a control gap between the punctured end seal and the tip of the piercing cone, over the face of the cone, through porous retainer, and into the passage 74. It will be understood that the entrance to passageway 74 is an ellipse defined by partial overlap of the base of cone 82 and the mouth of passageway 74. It should be noted that sealing gasket engages and seals the mouth of gas cartridge C but does not engage the piercing cone 82.

Figure 16:
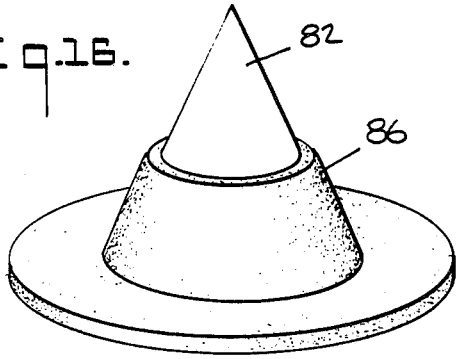
FIG. 16 is an enlarged perspective view of a modified retainer washer for a piercing cone.

As a further modification to the invention shown in FIG. 16, the retainer washer may be a rigid porous material capable of filtering particles of at least 0.003 inches in size. This form permits direct flow of gas through the porous retainer washer into the valve interior. The relative position of the retainer washer to the other portions of the piercing mechanism is as shown in FIG. 12. In this embodiment of the retainer washer, the flat spacing surfaces (**86*a* FIG. 14**) may be omitted. The porous rigid retainer washer may be formed in any suitable manner as for example by using a metal screen material or porous powdered metal parts.

The invention provides a dependable system for puncturing gas cartridges in gas guns. The device disclosed is of sturdy construction not to be broken by substantial forces required to puncture gas cartridges. The system permits use of commercially produced gas cartridges which vary in length as much as 0.080 inches. Moreover, the gas passages established past the puncturing mechanism are on the order of two-thousandths (0.002 of an inch) and accordingly serve as an effective filter to prevent contaminants from entering the interior of the valve mechanism. Such contaminants may enter from the outside or from the interior of the gas cartridge. In addition the piercing mechanism is such that a ridge is established within the interior of the gas cartridge to serve as a primary barrier against contaminants exiting from the gas cartridge. It will be understood further that there is a self-cleaning feature in the puncturing device of the present invention in that as a gas cartridge is removed from the gun, gas pressure remaining in the valve is vented outwardly from the piercing mechanism so to clear such contaminants as may be accumulated at or near the puncture point.

The invention may be embodied in other specific forms without departing from the spirit or essential characteristics thereof. The pressure embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A gas fired gun comprising:

a gun frame;

a barrel carried by said frame;

means carried by said frame defining a chamber for receiving a gas filled cartridge;

a trigger mechanism carried by said frame;

means responsive to actuation of said trigger mechanism for firing the gun including a valve body having a passage for communicating gas from the cartridge to the barrel and a bore opening into one end of said chamber, a valve member within said body normally sealing said passage, and a piercing member carried by said valve body in said bore adjacent the end of said chamber for piercing the end of the cartridge;

a retainer engageable with said piercing member in said bore;

a seal in said bore encompassing said piercing member for sealing about the pierced end of the cartridge; and an element coupled to said valve body for retaining said seal within said bore with said seal engaging said retainer to retain it and said piercing member in said bore, said retainer including means for spacing the retainer from the piercing member thereby to define and control the width of a gas flow path past said retainer and to retard flow of dirt particles from the cartridge into the valve body passage between said retainer and said piercing member.

2. A gun according to claim 1 wherein said piercing member has a base portion and a tip, said retainer being engageable with said base portion.

3. A gun according to claim 1 wherein said piercing member has a generally conical shape having a base portion and a tip, said retainer comprising a ring surrounding said base portion and having a portion projecting toward said tip in engagement with said seal.

4. A gun according to claim 3 wherein said projecting portion is comprised of a plurality of circumferentially spaced projections which prevent sealing contact of said seal with the piercing member.

5. A gun according to claim 4 wherein said projections are generally triangular in shape.

6. A gun as defined in claim 1 in which said retainer is porous to provide gas flow there through from the cartridge to the valve system.

7. A gun as defined in claim 6 in which the retainer is formed of a flexible porous material.

8. A gun as defined in claim 6 in which said retainer is formed of a rigid porous material.

9. A gun as defined in claim 8 which further includes means for backing-off the cartridge from the piercing member and in which said piercing member has an inclined piercing surface which together with the punctured cartridge defines a limited flow gap to facilitate gas flow and to retard dirt flow from the gas cartridge when the cartridge is backed off the piercing member.

10. A gun according to claim 1 wherein said piercing member has a base portion and a tip, said bore having a base and being stepped to define a shoulder spaced from the base of said bore, said retainer being engageable with said base portion and bearing against the base of said bore, said retainer having a portion projecting toward said tip, said seal bearing against the bore shoulder and said projecting retainer portion and being spaced from the portion of said retainer bearing against said bore base whereby said seal maintains said retainer about said piercing member and said piercing member bearing against the bore base.

11. A gun according to claim 10 wherein said piercing member has a generally conical shape, said retainer comprising a ring surrounding the base portion of said piercing member, said seal comprising an annular resilient washer for receiving the tip of said piercing member.

12. A gun according to claim 1 wherein said bore includes a base portion, said piercing member bears against the base of said bore and extends generally axially therealong, a portion of the passage opening into the bore being axially misaligned with said piercing member so that an edge portion of the piercing member and an outwardly offset portion of said passage cooperate to define an opening for flow of gas about the piercing member and into the passage portion.

13. A gun according to claim 1 including a loader assembly carried by said frame adjacent the opposite end of said chamber including an element movable toward and away from said piercing member, means for moving the last mentioned element toward said piercing member to engage and puncture the cartridge against said piercing member, and means for backing off the cartridge from said piercing member to enable gas flow from the cartridge into said valve body, said seal being resilient for maintaining the seal in sealing engagement about the pierced end of the cartridge when the cartridge is backed off the piercing member.

14. The improvement according to claim 13 wherein said piercing member has a base portion and a tip, said retainer being engageable with said base portion.

15. A gun according to claim 1 wherein said bore includes a base portion, said piercing member bears against the base of said bore and extends generally axially therealong, a portion of the passage opening into the bore being axially misaligned with said piercing member so that an edge portion of the piercing member and an outwardly offset portion of said passage cooperate to define an opening for flow of gas about the piercing member and into the passage portion.

16. A gun according to claim 1 including a loader assembly carried by said frame adjacent the opposite end of said chamber including an element movable toward and away from said piercing member, means for moving the last mentioned element toward said piercing member to engage and puncture the cartridge against said piercing member, and means for backing off the cartridge from said piercing member to enable gas flow from the cartridge into said valve body, said seal being resilient for maintaining the seal in sealing engagement about the pierced end of the cartridge when the cartridge is backed off the piercing member.

17. In a gas fired gun having a gun frame, a barrel carried by the frame, a chamber in the frame for receiving a gas filled cartridge, a trigger mechanism carried by the frame, and means responsive to actuation of the trigger mechanism for firing the gun including a valve assembly for communicating gas from the cartridge to the barrel having a bore opening into one end of the chamber and said bore having a base portion, the improvement comprising a piercing member carried by said valve assembly in said bore adjacent the one end of said chamber for piercing the end of the cartridge, a retainer engageable with said piercing member in the bore, a seal in the bore encompassing said piercing member for sealing about the pierced end of the cartridge; an element coupled to said valve assembly for retaining said seal within said bore with said seal engaging said retainer to retain it and said piercing member in said bore, said retainer being formed to enable flow of gas from the cartridge between said retainer and said piercing member, and said piercing member bearing against the base of the bore and extending generally axially therealong, the valve assembly including a passage opening into the bore, said passage being axially misaligned with said piercing member so that an edge portion of the piercing member and an outwardly offset portion of said passage cooperate to define an opening for flow of gas about the piercing member and into the passage.

18. The improvement according to claim 17 wherein said piercing member has a generally conical shape having a base portion and a tip, said retainer comprising a ring surrounding said base portion and having a portion projecting toward said tip in engagement with said seal.

19. The improvement according to claim 18 wherein said projecting portion is comprised of a plurality of circumferentially spaced projections which prevent sealing contact of seal with cone.

20. The improvement according to claim 17 wherein said piercing member has a base portion and a tip, the bore having a base and being stepped to define a shoulder spaced from the base of said bore, said retainer being engageable with said base portion and bearing against the base of the bore, said retainer having a portion projecting toward said tip, said seal bearing against the bore shoulder and said projecting retainer portion and being spaced from the portion of said retainer bearing against the bore base whereby said seal maintains said retainer about said piercing member and said piercing member bearing against the bore base.

21. The improvement according to claim 20 wherein said piercing member has a generally conical shape, said retainer comprising a ring surrounding the base portion of said piercing member, said seal comprising an annular resilient washer for receiving the tip of said piercing member.

* * * * *